United States Patent [19]

Reinhard et al.

[11] 4,273,027

[45] Jun. 16, 1981

[54] PNEUMATIC ACTUATING ARRANGEMENT, ESPECIALLY FOR CENTRAL LOCKING SYSTEMS, AND SHIFTING VALVES THEREFOR

[75] Inventors: Theodor Reinhard, Böblingen; Ernst Haug; Rüdiger Hoffmann, both of Sindelfingen; Dieter Feichtiger, Aidlingen, all of Fed. Rep. of Germany

[73] Assignee: Daimler-Benz Aktiengesellschaft, Stuttgart-Untertuerkheim, Fed. Rep. of Germany

[21] Appl. No.: 911,314

[22] Filed: Jun. 1, 1978

[30] Foreign Application Priority Data

Sep. 22, 1977 [DE] Fed. Rep. of Germany ..... 2742666

[51] Int. Cl.[3] ..... E05B 65/38; F15B 13/04

[52] U.S. Cl. ..... 91/32; 91/6; 70/264; 137/625.21; 137/625.69; 180/289

[58] Field of Search ..... 91/6, 32; 137/625.69, 137/625.48, 625.21, 625.25; 60/397, 411; 70/264, 263; 180/289

[56] References Cited

U.S. PATENT DOCUMENTS

| | | | |
|---|---|---|---|
| 743,985 | 11/1903 | Koelkebeck | 137/625.69 |
| 789,026 | 5/1905 | Huston | 137/625.69 |
| 2,060,684 | 11/1936 | Moorhouse | 60/411 X |
| 2,345,213 | 3/1944 | Oishei | 60/397 |
| 2,460,633 | 2/1949 | Franck | 137/625.4 X |
| 2,687,004 | 8/1954 | Rappl | 60/397 X |
| 3,084,757 | 4/1963 | Oishei et al. | 60/397 X |
| 3,110,353 | 11/1963 | Oishei et al. | 70/264 |
| 3,111,184 | 11/1963 | Oishei | 70/264 |
| 3,780,620 | 12/1973 | Gardner | 91/376 R |
| 3,831,489 | 8/1974 | Woo | 91/32 |
| 4,116,218 | 9/1978 | Acre et al. | 91/32 X |
| 4,181,191 | 1/1980 | Hoffman et al. | 180/289 |

*Primary Examiner*—Irwin C. Cohen
*Attorney, Agent, or Firm*—Craig and Antonelli

[57] ABSTRACT

A pneumatic actuating arrangement for to and fro movements, especially of a central locking system for motor vehicles, with an excess pressure source and with a vacuum source and with at least one pneumatic working device whose working chamber is adapted to be selectively connected to the excess pressure source or to the vacuum source by way of a shifting valve shiftable between two end positions. An intermediate for the shifting valve is provided in which position the shifting valve becomes temporarily effective during the transition from the one end position into the other end position so that the working chamber is conected to the atmosphere.

22 Claims, 5 Drawing Figures

PNEUMATIC ACTUATING ARRANGEMENT, ESPECIALLY FOR CENTRAL LOCKING SYSTEMS, AND SHIFTING VALVES THEREFOR

The present invention relates to a pneumatic actuating arrangement for to and fro movements, especially for central locking installations for motor vehicles, with a pressure source and a vacuum source and with at least one preferably single-chamber pneumatic operating element whose working chamber is adapted to be selectively connected to the pressure source or to the vacuum source by way of a shifting valve shiftable between two end positions, as disclosed in the German application No. P 27 15 136. 6 and corresponding U.S. Pat. No. 4,181,191.

The subject matter of the aforementioned German application is to utilize in connection with to and fro moving pneumatic working elements, excess pressure for the one movement direction and vacuum for the other movement direction so that a to and fro movement can be produced by means of only a single working line and by means of a single-chamber working element.

The object of the present invention resides in reducing the air requirement and thus the need in actuating or driving energy for the operation of the air pressure sources.

The underlying problems are solved according to the present invention in that an intermediate position which becomes effective during the transition from the one into the other of the two end positions is provided at the shifting valve, in which the working chamber or chambers are connected to the atmosphere. Owing to the intermediate venting of the working spaces and of the working lines during the transistion from the one to the other shifting position a pressure equalization with the atmosphere and not, for example, between the two energy storage or reservoir devices is brought about. The required driving or input energy can be reduced thereby to about one-half.

The present invention thereby utilizes preferably a pneumatic shifting valve having a housing with connections, in which a rectilinear or arcuately shaped slide valve member, movable between two end positions and provided with apertures delimited by sealing control edges, is supported in a guide means, in which terminate the connections, whereby a different pairing of the connections is operatively connected in the end positions of the slide valve member by apertures of the slide valve member.

In that regard, the present invention is concerned with the task to so construct the shifting valve that the intermediate venting or intermediate ventilation according to the present invention becomes possible by simple means.

The underlying problems are solved according to the present invention, as regards the shifting valve, in that a connection terminating in the atmosphere is provided at the housing and such an aperture is also provided on the slide valve member that during each displacement of the slide valve member from one of the end positions into the opposite end position, a connection of the working chamber with the atmosphere connection is temporarily established—after the heretofore effective energy connection for the energy supply from one of the pressure sources is disconnected and before the new energy connection is connected by the slide valve member.

Accordingly, it is an object of the present invention to provide a penumatic actuating system, especially for central locking systems of motor vehicles, and a shifting valve for such actuating arrangement which avoid by simple means the aforementioned shortcomings and drawbacks encountered in the prior art.

Another object of the present invention resides in a pneumatic actuating arrangement, especially for central locking systems and in a shifting valve for such actuating arrangement, which permit a considerable reduction in the air requirements and therewith in the requirement for the driving energy of air pressure sources.

Another object of the present invention resides in a pneumatic actuating installation of the type described above which is characterized by greater efficiency, yet is simple in construction and reliable in operation.

A further object of the present invention resides in a pneumatic actuating arrangement, especially for central locking systems of motor vehicles, which permits by extremely simple structural means a pressure equalization with the atmosphere during the transition from the one to the other end positions of the shifting valve.

Still a further object of the present invention resides in a shifting valve for a pneumatically operating actuating installation, especially for a central locking installation of a motor vehicle, which is relatively simple in construction, which involves relatively simple parts that can be manufactured and assembled by relatively inexpensive means and which assures high reliability of the operation of the system.

These and other objects, features and advantages of the present invention will become more apparent from the following description when taken in connection with the accompanying drawing which shows, for purposes of illustration only, several embodiments in accordance with the present invention and wherein.

Figure 4:
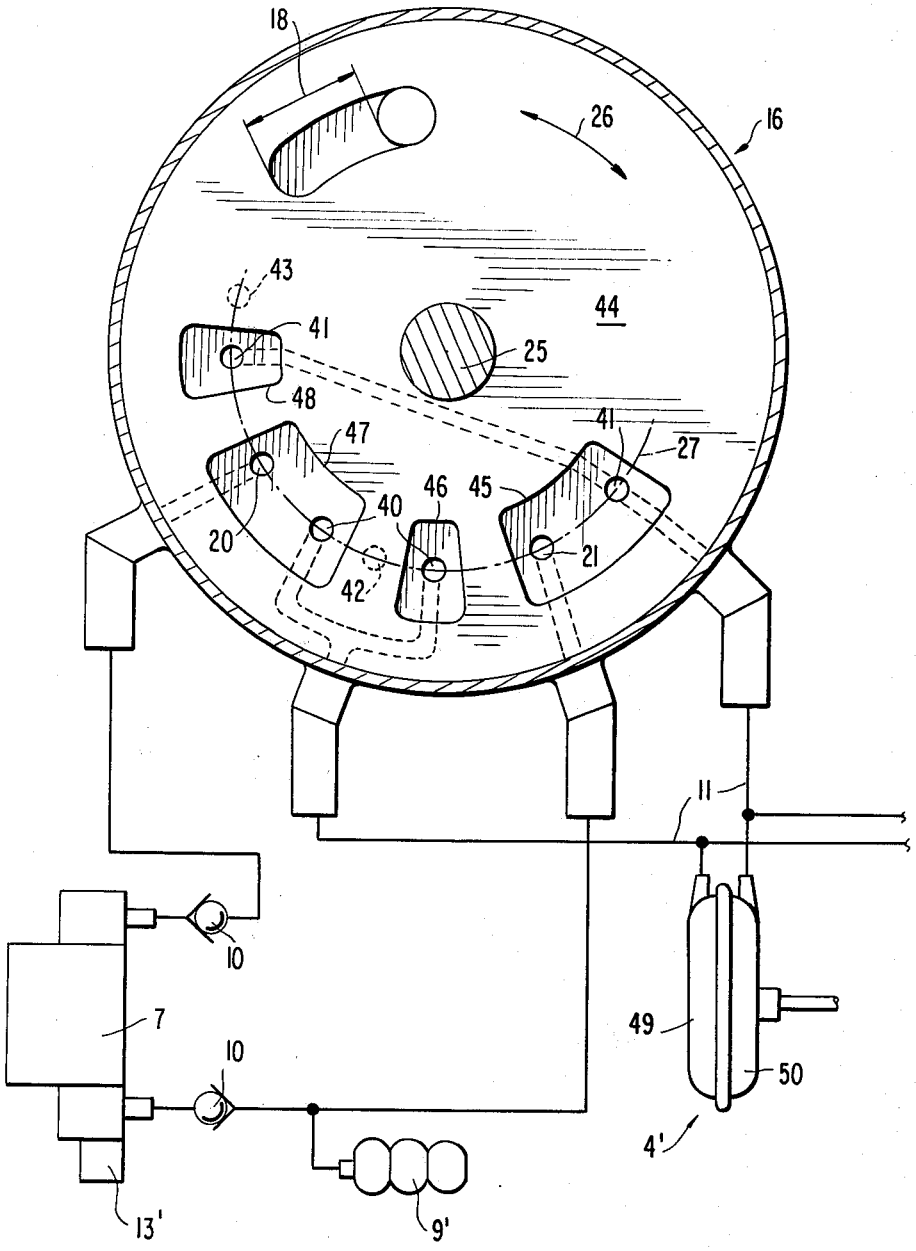
Figure 5:
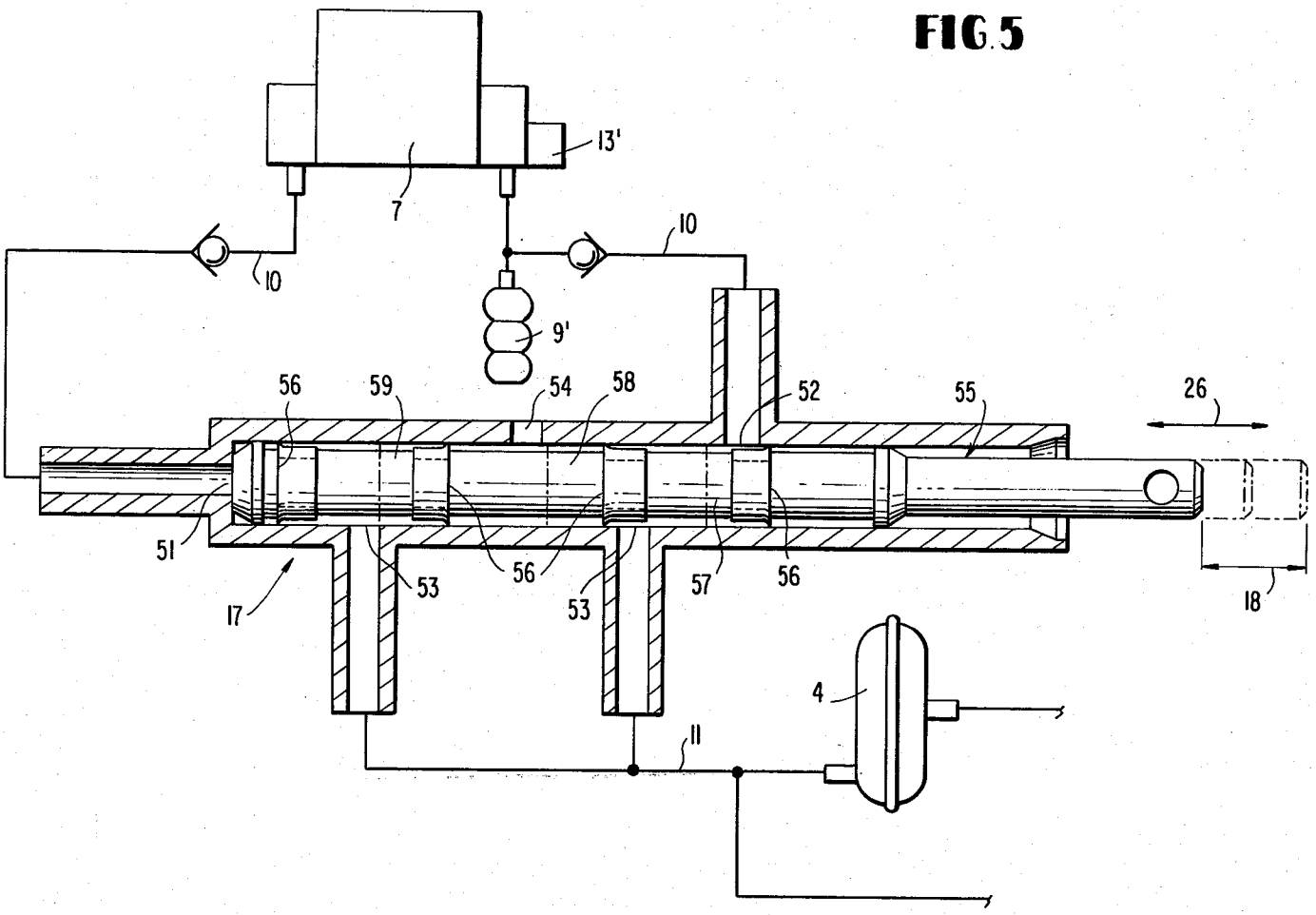

FIG. 4 is a somewhat schematic view of a further embodiment of a shifting valve according to the present invention, partly in cross section, for a two chamber working element, also constructed as rotary slide valve member; and FIG. 5 is a somewhat schematic cross sectional view through a still further embodiment of a shifting valve in accordance with the present invention constructed as piston slide valve.

Figure 1:
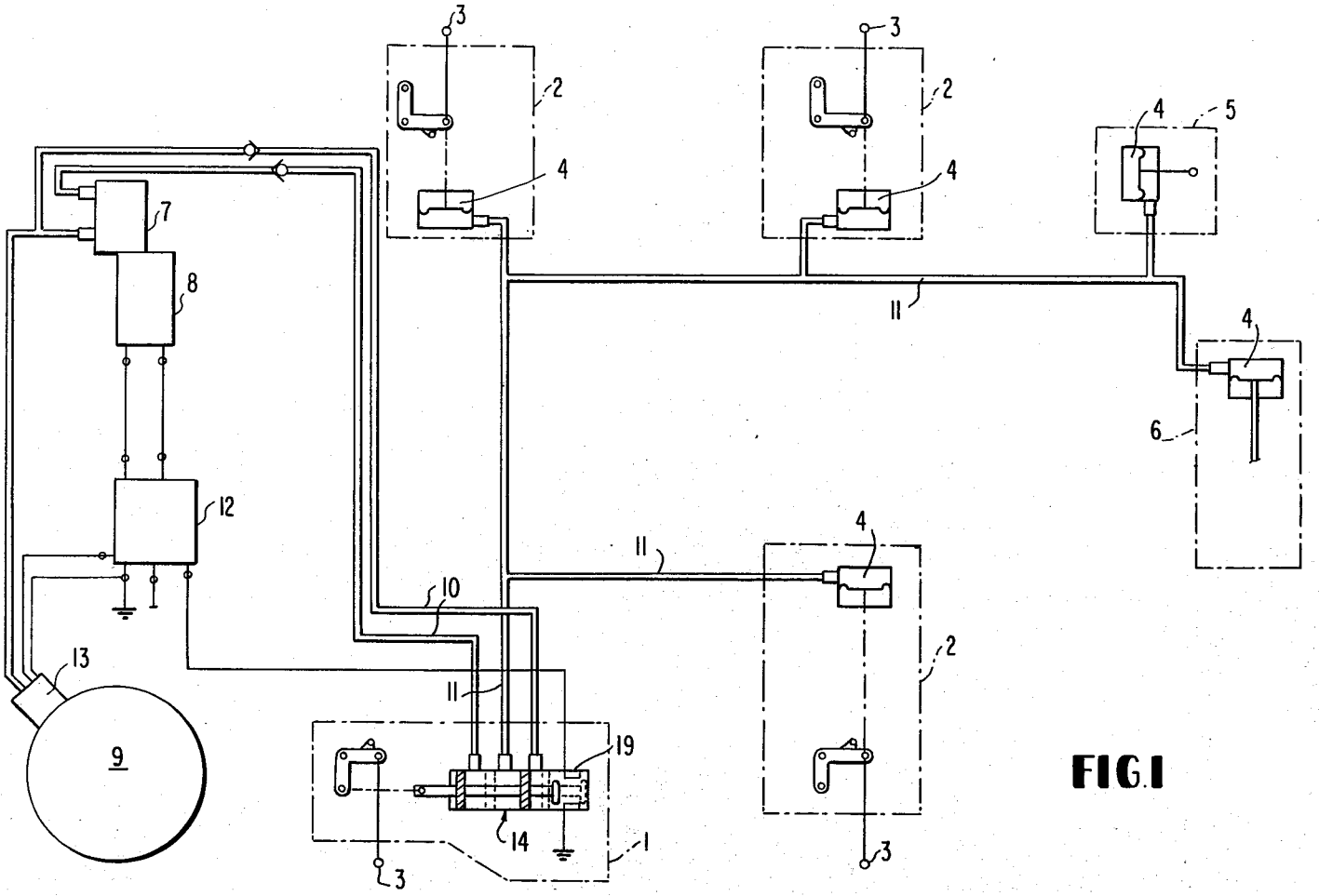
FIG. 1 is a schematic view of a central locking installation in accordance with the present invention for motor vehicles.

Referring now to the drawing wherein like reference numerals are used throughout the various views to designate like parts, in the central locking installation for motor vehicles which is schematically illustrated in FIG. 1, a driver door lock 1 is indicated schematically in dash and dotted lines while three further locks 2 for the remaining doors of the vehicle are also indicated in dash and dotted lines; furthermore, a luggage space lock 6 as well as a tank lid 5 with a locking means are included in the system shown in FIG. 1. A pneumatic working element 4 for the actuation of a locking mechanism, for example, of the lock buttons 3 at the door locks 2 is provided in each lock. The working element 4 is constructed as single chamber working device which is adapted to be acted upon with excess pressure in the one movement direction and with vacuum in the other movement direction and which is consequently controllable exclusively by a single working line 11. A shifting valve generally designated by reference numeral 14 is provided in the lock 1 of the driver door, which can be actuated either by the door key or by the locking knob 3 at this lock. Excess pressure or vacuum can be selectively conducted by way of the shifting valve 14 into the working line 11 and thus into the working elements 4.

For purposes of supplying the central locking installation with air, i.e., with a pressure or a vacuum, a double acting air pump 7 driven by a motor 8 is provided, which produces excess pressure at one of its connections and vacuum at the other of the two connections. The vacuum may be stored in the storage tank or reservoir device 9 of conventional construction. The connections of the pump are connected by way of correspondingly interposed check valves with the shifting valve 14 by way of energy lines 10. The shifting valve 14 is operatively connected with a switch 19 which during each actuation of the shifting valve 14 produces a current pulse that is fed to the relay 12. This shifting relay 12 turns on the pump 7 for a predetermined short period of time so that the pneumatic energy required for the locking operation respectively unlocking operation can be produced or replenished. The storage device 9 is provided with a pressure valve 13 which during a drop of the reservoir pressure below a predetermined threshold value automatically turns the pump 7 on by way of the relay 12 and again automatically turns the pump 7 off upon exceeding a predetermined threshold value.

Figure 2:
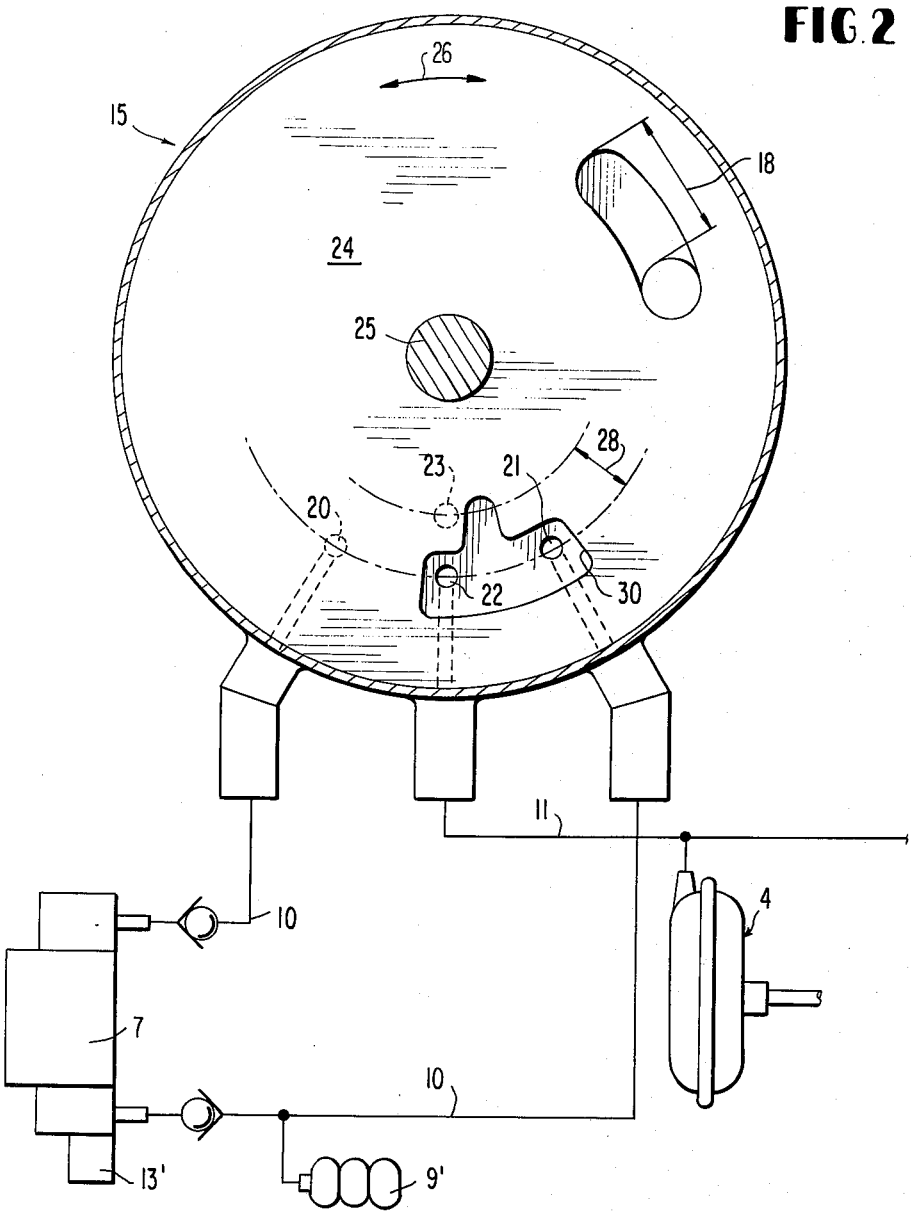
FIG. 2 is a somewhat schematic view of a first embodiment of a shifting valve, partly in cross section, with an intermediate venting according to the present invention.
Figure 3:
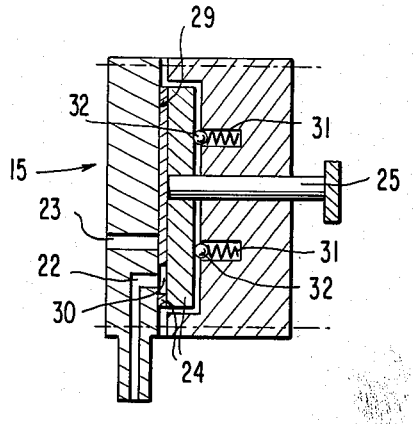
FIG. 3 is an axial cross-sectional view, on a reduced scale, through the shifting valve according to FIG. 2, taken at right angle to the cross section of FIG. 2.

A shifting valve generally designated by reference numeral 15 with an intermediate venting possibility which is provided with a rotary slide valve member 24 is illustrated in FIGS. 2 and 3. The rotary slide valve member 24 which is sealingly supported in a housing is rotatable about the axis of the shaft 25 in the direction of the arrow 26 through the adjusting path 18. The slide valve member 24 is sealingly pressed against the surface of the housing 29 (FIG. 3) which forms a guide for the valve member 24. On the side facing the surface of the housing 29, the slide valve member 24 is provided with a layer having good sealing properties, into which an aperture 30 is worked in or machined in, by means of which different connections at the valve can be operatively connected depending on the shifting position. The valve 15 is provided altogether with four connections 20 to 23. The outwardly disposed connections 20 and 21 serve for the energy supply and more particularly the connection 20 for the excess pressure and the connection 21 for the vacuum. A working connection 22 is arranged centrally between the connections 20 and 21 which is operatively connected with the working line 11 and with the working chambers of the adjusting devices 4. The spacing of the connections along a line of alignment 27—formed by a circular arc—amounts to about a shifting path 18 respectively the angle corresponding thereto. The three connections 20, 22 and 21 are disposed on a single alignment line 27 parallel to the movement direction of the slide valve member 24. A venting connection 23 is arranged transversely offset thereto by a certain lateral offset 28, which venting connection terminates freely in the atmosphere. The aperture 30 is constructed approximately T-shaped, whereby, in an intermediate position in which the aperture 30 does not overlap either the opening 20 or the opening 21, the working connection 22 and the atmosphere connection 23 are connected with each other by way of the aperture 30.

This intermediate position is temporarily occupied by the aperture 30 during the transition from the one into the other end shifting position of the rotary slide valve member 24 and the working connection respectively the working line 11 is operatively connected with the atmosphere during a certain transitional period of time. This small transitional period of time suffices for the venting or the ventilation of the working chambers and for a far-reaching atmospheric pressure equalization.

In order that the intermediate position is not traversed excessively rapidly during the shifting operation and the venting period of time is not made too brief, the valve, as indicated in FIG. 3, may be provided with a shifting brake which may be constructed in the form of abutment springs 31 and detent balls 32 which can engage into spherical detents or recesses of the slide valve member. The detent positions are provided in a circumferential position corresponding to the intermediate position. The pressing action of the end face of the rotary slide valve member 24 against the surface 29 by means of the sealing coating or sealing layer of the rotary slide valve member also produces a further braking effect.

The drive of the rotary slide valve member 24 takes place appropriately from a lock cylinder of the door lock and, for that purpose, the shifting valve is appropriately arranged coaxially to the lock cylinder and is non-rotatably connected therewith for rotation in unison therewith.

By a multiple arrangement of the connections 20 to 23 as well as of the aperture 30 in different circumferential positions of the shifting valve 15, the shifting valve 15 may also be constructed for the actuation respectively admission of pressure or vacuum to two-chamber working elements.

The shifting valve illustrated in FIG. 4 which is generally designated by reference numeral 16 is constructed beforehand for the actuation of two-chamber working devices 4'; however, the principle of the shifting valve 16 illustrated in this embodiment is also suitable for the control of single-chamber working devices. For that purpose, certain connections only need to be closed off air-tight or they can be dispensed with beforehand.

In the shifting valve according to FIG. 4, altogether eight connections are arranged at different distances to one another in the housing along a single line of alignment 27 which extends parallel to the direction of movement 26 of the rotary slide valve member 16. The mutual spacings of two adjacent connections are approximately either one full displacement path 18 of the rotary slide valve member or a half a displacement path—i.e., a large or a small spacing. The working and energy connections have a large spacing with respect to one another and only the interposed atmosphere connections have a small spacing to the adjacent connections. Beginning on the right side and continuing in the clockwise direction, at first a first working connection 41 is provided, which is followed by a first energy connection 21, and more particularly for vacuum with two working connections 40 in communication with each other then following with a large spacing with respect to one another, between which an atmosphere connection 42 is provided centrally thereof. An energy connection 20 for excess pressure is again arranged at a large distance with respect to the left working connection 40, which is again followed at a large distance by a further working connection 41 which is connected with the first mentioned working connection 41. A further atmosphere connection 43 is provided at a small spacing with respect to the second-mentioned working connection 41. Altogether four apertures 45, 46, 47 and 48 are provided in the slide valve member which correspond in a radial respect approximately to the alignment line 27. Of these four apertures, two apertures 45,47 are constructed longer and two apertures 46,48 are constructed somewhat shorter, and more particularly the longer apertures 45,47 correspond to the adjusting path 18 whereas the shorter apertures 46,47 have a length which is about one-third as long. The long apertures 45,47 are longer by the width of a connection than a large spacing between two connections. The shorter apertures 46,48 are so long that they can simultaneously connect with each other a working connection and the adjacent atmosphere connection. The shorter apertures 46,48 are offset with their center by about one-half an adjusting path length with respect to the end of the adjacent aperture.

The shifting valve 16 is disposed in the illustrated shifting position in such an end position, in which the right working chamber 50 is acted upon with vacuum and the left working chamber 49 with excess pressure. The two connections 21 and 41 are connected with each other by the aperture 45 and the two connections 20 and 40 by the aperture 47. The two energy connections 40 and 41 that are not needed and that are not directly connected with a working connection by an aperture are disposed in the illustrated end position inside of a small aperture and are thereby sealed off with respect to the other apertures.

For purposes of shifting the valve 16 into the other end position, the slide valve member 44 has to be displaced in the clockwise direction through the path or distance 18. The two working connections 41 and 40 which were previously disposed inside of the large apertures in the right portion thereof are thereby covered by the land surface of the slide valve member 44 so that only one energy connection 20 respectively 21 remains arranged inside of a large aperture 45 respectively 47 and the energy supply to other connections is sealed off. In an intermediate position, with a sealed off energy supply to the energy connections 20 and 21, the heretofore inoperable working connections, and more particularly the right connection of the two connections 40 and the left connection of the two connections 41 are temporarily connected with the corresponding adjacent atmosphere connections 42 respectively 43 by means of the small apertures 46 and 48 during the further rotation of the slide valve member 44. A pressure equalization of the working chambers 49 and 50 with the atmosphere can take place thereby.

During the further rotation of the slide valve member 44 in the clockwise direction completely into the other end shifting position, the small apertures 46 and 48 are displaced beyond the atmosphere connections 42 and 43 and the large apertures 45 and 47 connect the energy connections 21 and 20 with a heretofore inoperable working connection 40 and 41, namely, with the right working connection 40 and with the left working connection 41, respectively. The working connections 40 and 41, not operable in the new end shifting position, are covered off and sealed off by the land surface of the slide valve member 44. In the new end shifting position the working space 50 is connected with excess pressure and the working space 49 with vacuum; in the illustrated end shifting position of FIG. 4, the reverse is exactly true.

In the shifting valve illustrated in FIG. 5 and generally designated therein by reference numeral 17, a piston-like slide valve member generally designated by reference numeral 55 is arranged in a cylindrical housing having altogether five connections and is movable to and fro through the adjusting path 18. Four sealing lips or sealing spools 56 are arranged on the piston slide valve member 55 approximately at the same mutual distance, by means of which three mutually sealed-off apertures 57, 58 and 59 are created. The right aperture 57 may also be constructed longer. Strictly speaking, the space to the left of the outermost sealing lip 56 is to be also regarded as a fourth aperture respectively as a controllable space.

Two working connections 53 are arranged in the housing at a distance that corresponds approximately to the lip spacing plus the adjusting path length 18. The working connections 53 are connected with each other and with the working line 11 which leads to the working chamber of the working device 4. The atmosphere connection 54 is arranged in the housing approximately centrally between these two working connections 53. An energy connection 51 for excess pressure and an energy connection 52 for vacuum are provided in the housing outwardly offset with respect to the two working connections 53 by about an adjusting path length.

In the illustrated left end shifting position, the working chamber of the working device 4 is acted upon with vacuum by way of the vacuum connection 52 and by way of the right aperture 57 and the right working connection 53. The left working connection 53 is dead-end connected by the left aperture 59 and is thereby sealed off with respect to the excess pressure connection 51 and with respect to the atmosphere connection 54.

The position of the sealing lips 56 in the other end shifting position is indicated in dash and dotted lines. During the transition into this other end shifting position, an intermediate position is reached, in which the second sealing lip 56 from the right has traversed the right working connection 53. In this intermediate position, the right working connection 53 is connected with the atmosphere connection 54 by way of the central aperture 58 and a venting or ventilation of the working chamber and of the working line 11 can take place. During the further shifting movement completely into the other end shifting position, the third sealing lip 56 from the right traverses the atmosphere connection 54 and the entire left sealing lip traverses the left working connection 53. In this end shifting position indicated in dash and dotted lines, the vacuum connection 52 is dead-end connected by the right aperture 57. Furthermore, the right working connection 53 is dead-end connected by the center aperture 58 and is sealed off with respect to the connections 52 and 54. Only the left working connection 53 is connected with the excess pressure connection 51. During the transition from the illustrated end shifting position, in which the working chamber is acted upon with vacuum, into the other end shifting position via an intermediate venting position, the working chamber is therefore acted upon with excess pressure. Also during the return displacement from the excess pressure end shifting position into the illustrated vacuum-end shifting position, the intermediate position with venting possibility is traversed; consequently, an intermediate venting or ventilation takes place each time.

For purposes of avoiding condensation or sweating water formation, the arrangement in the central locking installation according to FIG. 1 is made in such a manner that in the closing or locking position—the position which lasts longer from a time point of view than the other position—the working devices are acted upon with vacuum. As a result thereof, the working devices and shifting valves are kept dry and remain trouble-free.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A pneumatic actuating arrangement for a central locking system of motor vehicles, the pneumatic actuating arrangement being adapted to open and close locking means of the motor vehicle, the actuating arrangement comprising an excess pressure source means, a vacuum source means, and at least one working device, the at least one working device having a single working chamber means, a single shifting valve means for selectively connecting the single working chamber means with the excess pressure source means and vacuum source means, the shifting valve means being shiftable between two end positions, characterized in that the shifting valve means connects the working chamber means with the excess pressure source means in one end position to act in said working chamber means to move the working device in one direction and connects the working chamber means with the vacuum source means in the second end position to act in said working chamber means to move the working device in an opposite direction, the shifting valve means is shiftable into an intermediate position which becomes effective temporarily during a transition of the shifting valve means from one of the two end positions into the other of the two end positions, and in that the shifting valve means connects the working chamber means with the atmosphere solely when the shifting valve means is in the intermediate position.

2. A pneumatic actuating arrangement according to claim 1, characterized in that the shifting valve means includes housing means having a plurality of connection means, a first one of said connection means is an excess pressure connection means for enabling the shifting valve means to connect the excess pressure source means to the working chamber means, a second one of said connection means is a vacuum source connection means for enabling the shifting valve means to connect the working chamber means with the vacuum source means, a third one of said connection means is an atmosphere connection means for enabling the shifting valve means to connect the working chamber means with the atmosphere, and a slide valve member displaceable between the two end positions, the slide valve member is provided with aperture means delimited by sealing control edges, the housing means include guide means for guiding the slide valve member for displacement within said housing means, each of said connection means terminate in the guide means, the aperture means of the slide valve member are adapted to operatively connect a different pair of the connection means when the slide valve member is in the end positions one of said aperture means is arranged on the slide valve member such that, during each displacement of the slide valve member from one of the end positions into the other end position wherein one of the source means is disconnected from the working chamber means and the other source means is connected to the working chamber means, the last-mentioned aperture means is effective to temporarily operatively connect the working chamber means to the atmosphere connection means before connecting the other source means to the working chamber means.

3. A pneumatic actuating arrangement according to claim 2, characterized in that the slide valve member is movable substantially rectilinearly.

4. A pneumatic actuating arrangement according to claim 2, characterized in that the shifting valve means is movable substantially along a path of arcuate shape.

5. A pneumatic actuating arrangement according to claim 2, characterized in that a plurality of working connection means are provided for connecting the shifting valve means with the working chamber means, said one of said aperture means provided on the slide valve member has a configuration such that, when the shifting valve means is in the intermediate position, the aperture means simultaneously overlaps one of the working connection means and the atmosphere connection means, and in that the atmosphere connection means is arranged laterally offset transversely to the displacement direction of the slide valve member with respect to a line connecting the vacuum source connection means and pressure source connection means taken parallel to the displacement direction of the slide valve member.

6. A pneumatic actuating arrangement according to claim 2, characterized in that two working connection means are provided for connecting the shifting valve means with the working chamber means, the two working connection means are operatively connected with each other and are arranged in the housing means along a displacement direction of the slide valve member approximately at a distance of the end positions of the slide valve member corresponding to a displacement path thereof, the atmosphere connection means is arranged approximately centrally between the two working connections, at least one of the pressure source connection means and vacuum source connection means is provided in the housing means displaced outwardly by a displacement path of the slide valve member, and in that the aperture means provided on the slide valve member includes three mutually separated aperture means arranged in series.

7. A pneumatic actuating arrangement according to claim 6, characterized in that the aperture means are constructed of approximately equal length, the slide valve member is constructed as a piston slide valve member, and in that series arranged aperture means are separated from one another by four circumferential line-shaped sealing means.

8. A pneumatic actuating arrangement according to claim 7, characterized in that the sealing means are sealing lips disposed on the piston slide valve member.

9. A pneumatic actuating arrangement according to claim 6, characterized in that of the series arranged aperture means on the slide valve member, a first and third aperture means are approximately as long as the displacement path of the slide valve member and the second aperture means is disposed approximately centrally therebetween, the second aperture means is approximately one third as long as the displacement path of the slide valve member, and in that a land surface between the respective aperture means sealingly abuts at one of the housing means and the connection means.

10. A pneumatic actuating arrangement according to claim 8, characterized in that the slide valve member is constructed as a plate slide valve member.

11. A pneumatic actuating arrangement according to claim 9, characterized in that the working device includes two working chamber means, the respective working chamber means are adapted to simultaneously be exposed to vacuum from the vacuum source means and an excess pressure from the excess pressure means, two further working connection means are arranged at the housing means offset outwardly at the shifting valve member by about a displacement path of the slide valve member with respect to the pressure source connection means and the vacuum source connection means, the two further working connection means being operatively connected with each other and being in communication with the second working chamber means, a further atmosphere connection means is provided at the housing means offset in the displacement direction of the slide valve member by about one third of the displacement path with respect to at least one of the further working connection means, and in that a further aperture means is provided in the slide valve member within an area of the further atmosphere connection means, the further aperture means essentially corresponds in size and spacing to the second aperture means.

12. A pneumatic actuating arrangement according to one of claims, 2, 5, 6, 7, 9 or 11, characterized in that the slide valve member includes a brake means for delaying an excessively rapid shifting from one end position to the other end position.

13. A pneumatic actuating arrangement according to claim 12, characterized in that the brake means includes a detent means adapted to be overcome by pressure.

14. A pneumatic actuating arrangement according to one of claims, 2, 5, 6, 7, 9, or 11, characterized in that the slide valve member is maintained in one of the end positions for a period of time which is longer than the period of time that the slide valve member is maintained in the other end position, and in that in said one end position the working chamber means is connected to the vacuum source means.

15. A pneumatic actuating arrangement according to claim 14, characterized in that the slide valve member includes brake means for delaying an excessively rapid shifting of the slide valve member from one end position to the other end position.

16. A pneumatic actuating arrangement according to claim 1, characterized in that the shifting valve means is constructed as a sliding valve which includes a slide valve member and a housing for accommodating the slide valve member, a plurality of connection means are provided on the housing for selectively connecting the working chamber means with at least one of the pressure source means, vacuum source means, and the atmosphere, means are provided on the slide valve member for controlling a communication between the respective connection means and the working chamber means, the connection means for connecting the working chamber means are arranged such that, in one end position, the working chamber means is connected to the excess pressure source means and, in the other end position, the working chamber means is connected to the vacuum source means, and in that during each displacement of the slide valve member from one end position to the other end position, the slide valve member temporarily connects the working chamber means with the atmosphere.

17. A pneumatic actuating arrangement according to claim 16, characterized in that the slide valve member is movable substantially rectilinearly.

18. A pneumatic actuating arrangement according to claim 16, characterized in that the slide valve member is movable substantially along a path of arcuate shape.

19. A pneumatic actuating arrangement according to one of claims 16 or 17, characterized in that the slide valve member is a piston-like valve member, and in that the means provided on the slide valve member for controlling the communication between the respective connection means and the working chamber means includes a plurality of spaced sealing means arranged on the piston-like valve member and being adapted to cooperate with the connection means.

20. A pneumatic arrangement according to claim 19, characterized in that the sealing means are arranged on the piston-like valve member at approximately a mutual distance from each other.

21. A pneumatic actuating arrangement according to claim 20, characterized in that the housing includes two spaced working connection means for connecting the slide valve member with the working chamber means, the working connection means are spaced from each other by a distance corresponding approximately to the distance between the sealing means plus a distance corresponding to an adjusting path of the slide valve member, and in that the connection means for connecting the working chamber means with the atmosphere is disposed approximately centrally of the working connection means.

22. A pneumatic actuating arrangement according to claim 21, characterized in that the connection means for connecting the slide valve member with the excess pressure source means and the vacuum source means are disposed outwardly of the two working connection means.

* * * * *